US006935408B2

(12) United States Patent
von Wyl et al.

(10) Patent No.: US 6,935,408 B2
(45) Date of Patent: Aug. 30, 2005

(54) METHOD FOR PRODUCING STEEL SLABS

(75) Inventors: Horst von Wyl, Duisburg (DE); Ingo Schubert, Siegburg (DE); Jung Wolfram, Siegen (DE)

(73) Assignee: SMS Demag AG, Düsseldorf (DE)

( * ) Notice: Subject to any disclaimer, the term of this patent is extended or adjusted under 35 U.S.C. 154(b) by 0 days.

(21) Appl. No.: 10/344,053

(22) PCT Filed: Jul. 25, 2001

(86) PCT No.: PCT/EP01/08577

§ 371 (c)(1),
(2), (4) Date: Jun. 19, 2003

(87) PCT Pub. No.: WO02/11925

PCT Pub. Date: Feb. 14, 2002

(65) Prior Publication Data

US 2004/0006862 A1 Jan. 15, 2004

(30) Foreign Application Priority Data

Aug. 10, 2000 (DE) ..... 100 39 016

(51) Int. Cl.[7] ..... B22D 11/20
(52) U.S. Cl. ..... 164/454; 164/484; 164/478
(58) Field of Search ..... 164/484, 478, 164/416, 454, 154.1, 442, 145.1

(56) References Cited

U.S. PATENT DOCUMENTS 3,891,025 A 6/1975 Bollig et al. ..... 164/154
5,031,687 A * 7/1991 Bollig et al. ..... 164/442
6,401,799 B1 * 6/2002 Arai et al. ..... 164/463
6,701,999 B2 * 3/2004 Von Wyl et al. ..... 164/484

FOREIGN PATENT DOCUMENTS

DE 197 20 768 C1 1/1999

* cited by examiner

*Primary Examiner*—Jonathan Johnson
*Assistant Examiner*—Len Tran
(74) *Attorney, Agent, or Firm*—Friedrich Kueffner

(57) ABSTRACT

A method for producing steel slabs, whereby the strand leaves an ingot mold with melt enclosed by a strand shell and, in a strand guide located downstream, the opening width of guide rolls mounted in segments with upper and lower frames can be set in a continuous manner with successive steps by adjusting elements that join said guide rolls. An oscillation around a center line of the opening width serves to modify the opening width in order to render the dynamic influences on the guide rolls negligibly small. The amplitude of the opening width oscillation is set to ta quantity, which des not provoke any plastic deformation of the strand shell. The actual opening width of the guide rolls is detected and the actuating force of the adjusting elements as well as the amplitude of the actuating force are determined at the same time. In the case of an increasing amplitude of the actuating force, the opening width is set to a predeterminable measure and/or guided in a pressure controlled manner via at least one adjusting element. A force/path diagram of the opening width setting is then determined form a multitude of force/path measurements along the strand. Said diagram is composed, in a chain-like manner, of a multitude of small force path curves, which are each provided in the form of a hysteresis and which can be individually determined using an oscillation with a comparatively small amplitude.

5 Claims, 1 Drawing Sheet

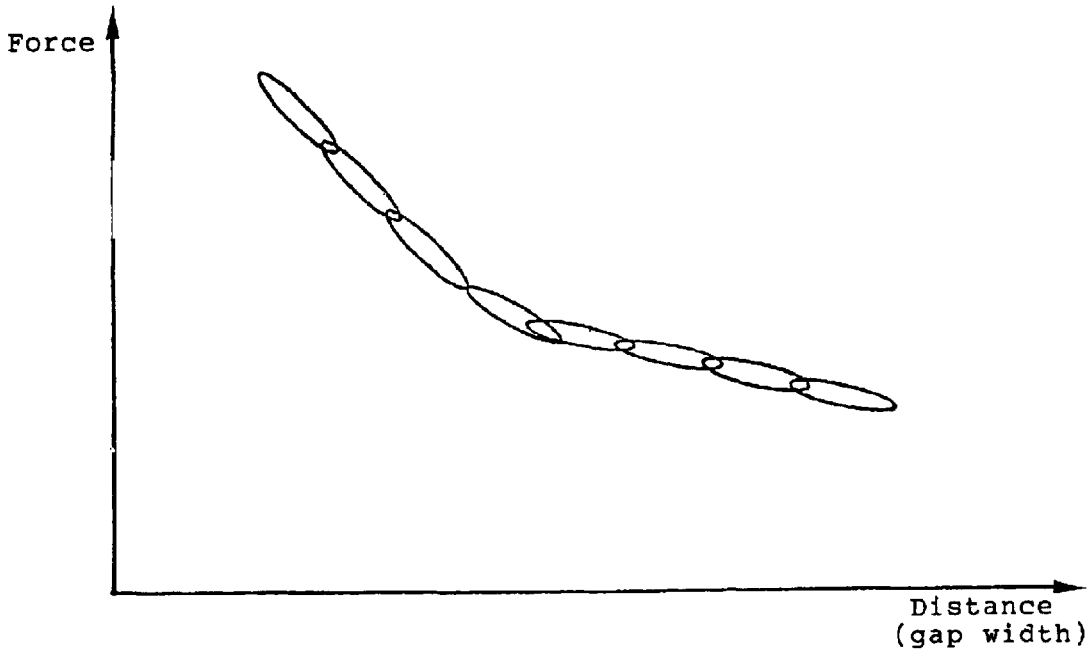
Force
Distance
(gap width)

METHOD FOR PRODUCING STEEL SLABS

BACKGROUND OF THE INVENTION

1. Field of the Invention

The invention pertains to a method for producing steel slabs, where the strand leaving the mold contains molten metal enclosed by a strand shell, and where, in a following strand guide system, the gap width of the guide rolls, which are supported in segments in an upper and a lower frame, can be adjusted continuously in successive steps by adjusting elements which connect the rolls, where (a) the gap width is changed by oscillation around a centerline of the gap width in such a way that the dynamic influences on the guide rolls are negligibly small;

(b) the amplitude of the gap width oscillations is set to a value which does not cause any plastic deformation of the strand shell;

(c) the current gap width of the guide rolls is detected;

(d) simultaneously, the actuating force of the adjusting elements and the amplitude of the actuating force are determined; and (e) when the amplitude of the actuating force increases, the gap width is adjusted to a predetermined value and/or is guided as a function of pressure by means of at least one adjusting element.

2. Description of the Related Art

The method described in DE 197 20 768 C1 has the goal of creating a basis on which it is possible to adjust the gap width with precision over the entire strand guide system by the use of simple measuring devices and simple mathematical means. It also has the goal of making it possible to determine reliably the current position of the tip of the crater inside the slab.

The method is based essentially on a dynamic measurement by excitation of the strand in the form of oscillations, as a result of which it can be recognized whether the gap width is tending to become larger or smaller than the optimum gap width at a specific measurement site, so that, if a deviation is detected, suitable measures can be taken to correct it.

When the dynamic measurement is made, the actuating force produces a hysteresis curve relative to the gap width. This curve has a relatively small area when the shell is still thin and the crater relatively large. The hysteresis curve has a relatively large area, however, after the shell has grown and the volume of the crater has decreased. The curve has a very slender form when the strand is completely solidified.

In the known method, the gap width is changed by an oscillation around a predetermined centerline of the desired slab thickness. Characteristic force-distance curves are analyzed, for which purpose the slopes of the characteristic curves in the force-distance plane, their points of intersection, etc., are taken into consideration for the required evaluation.

Although it is stated in the document cited that the selected oscillation value should be chosen so that the dynamic influences on the strand shell, which is still relatively thin after leaving the mold, remain negligibly small and that the amplitude of the oscillating gap width should be set to a value which prevents the plastic deformation of the strand shell, the expert cannot derive any clear, reproducible principle for concrete action from this information. For the known method is based at least implicitly on the fact that the amplitude of the force-distance characteristic on which the mathematical analysis is based is determined within the scope of only a single oscillation period, which means that the measurement distance consists only of the distance covered by a single stroke.

Practical measurements in the situation described above, however, have shown that the stroke would have to be so large that, depending on the starting point of the oscillation, there would be an acute danger of the plastic deformation of the strand shell, deformation which would lead to cracks in the microstructure.

SUMMARY OF THE INVENTION

Against the background of the insights and practical findings described above, the invention is based on the task of improving and elaborating the known method in such a way that the technical measurements which are performed yield optimum results, so that the disadvantages and difficulties caused by harmful deformation of the strand shell or disturbances of its microstructure, such as cracking, can be avoided with all possible reliability.

To accomplish this task, it is proposed within the scope of a method of the type indicated in the introductory clause of the independent claim, that a diagram of the gap width settings be determined on the basis of a plurality of force-distance measurements along the strand, this diagram being composed of a plurality of small force/distance curves forming a chain-like pattern, each curve being in the form of a hysteresis curve, each of which can be determined by means of an oscillation of comparatively small amplitude. Thus the disadvantages and difficulties of the previous type of measurement procedure are reliably avoided, and a strand with the optimum microstructure can be obtained.

It is important in actual casting operations for the optimum gap width of the strand guide system to be determined and adjusted not only reliably but also as quickly as possible. For this reason, it should therefore be possible to determine whether the gap width is "too big" or "too small" after each small-amplitude oscillation. For this purpose, the slope of each small hysteresis curve of the "chain" is evaluated. This corresponds to the stiffness of the "segment-strand" system at the measurement site in question. This stiffness value can then be compared with values stored in a database, which-has been prepared for the segment control system. This database contains empirical stiffness values, which pertain to strands of different widths and solidification states such as those characterized by a liquid crater or the advancing solidus/liquidus transition region.

A comparison with values of this database, which can be interpolated or extrapolated as required, provides information on how the actual gap width compares with the optimum gap width.

An elaboration of the invention also provides that the position of the tip of the crater can be determined from a change in the area of the hysteresis curve, e.g., from a decrease in the area.

And, finally, it is advantageous that an increase in the consistency of the strand can be determined from a change in the area of the hysteresis curve, such as from a decrease in the area.

BRIEF DESCRIPTION OF THE DRAWING

An example of the invention is presented in the form of the attached drawing:

DETAILED DESCRIPTION OF THE DRAWING

This consists of a plurality of small force-distance curves, each of which was determined individually by means of one oscillation of small amplitude. On this basis, both a reliable and also a rapid determination and adjustment of the optimum gap width can be recognized and implemented within the framework of practical casting operations. In addition, it is possible to know whether the gap width is too big or too small and must be corrected after only one oscillation of very small amplitude. The individual curves, each representing a hysteresis curve, engage with each other like the links of a chain and show the course of the actuating force versus the gap width along the strand.

The invention therefore represents, so to speak, an "x-ray image" of the strand and provides an optimum solution to the problem described above.

What is claimed is:

1. Method for producing steel slabs, where the strand leaving the mold contains molten metal enclosed by a strand shell, and where, in a following strand guide system, the gap width of the guide rolls, which are supported in segments in an upper and a lower frame, can be adjusted continuously in successive steps by adjusting elements which connect the rolls, comprising (a) changing the gap width by oscillation around a centerline of the gap width in such a way that the dynamic influences on the guide rolls are negligibly small;

(b) setting the amplitude of the gap width oscillations to a value which does not cause any plastic deformation of the strand shell;

(c) detecting the current gap width of the guide rolls;

(d) simultaneously determining the actuating force of the adjusting elements and the amplitude of the actuating force; and (e) wherein when the amplitude of the actuating force increases, the gap width is adjusted to a predetermined value and/or is guided as a function of pressure by means of at least one adjusting element, wherein a force/distance diagram of the gap width setting is determined on the basis of a plurality of force/distance measurements along the strand, which diagram is composed of a plurality of small force/distance curves linked like a chain, each in the form of a hysteresis curve, each of which can be determined by means of an oscillation of comparatively small amplitude, and characterized in that whether the adjusted gap width of the guide rolls is deviating from the optimum value in the direction of "too big" or "too small" is determined on the basis of each hysteresis curve after only one oscillation of comparatively small amplitude, whereupon a corresponding correction is made.

2. Method according to claim 1, wherein each curve, determined in the form of a hysteresis curve, is determined and evaluated in accordance with its slope as an index of the current stiffness of the "segment-strand" system.

3. Method according to claim 1, wherein the characteristic stiffness value which has been determined is compared with data stored in a database supplied with empirical values, which can be interpolated or extrapolated as required, and in that recognizable deviations are corrected by appropriate adjustment of the gap widths.

4. Method according to claim 1, wherein the position of the tip of the crater is determined from a change in the area of the hysteresis curve, e.g., in the case of a decrease in the area.

5. Method according to claim 1, wherein an increase in the consistency of the strand is determined from a change in the area of the hysteresis curve, e.g., in the case of a decrease in the area.

* * * * *